United States Patent [19]

Dannoura

[11] Patent Number: 4,860,818

[45] Date of Patent: Aug. 29, 1989

[54] DIE CASTING APPARATUS

[75] Inventor: Sadayuki Dannoura, Yamaguchi, Japan

[73] Assignee: Ube Industries, Ltd., Ube, Japan

[21] Appl. No.: 247,129

[22] Filed: Sep. 20, 1988

[30] Foreign Application Priority Data

| | | | |
|---|---|---|---|
| Sep. 21, 1987 | [JP] | Japan | 62-236637 |
| Sep. 21, 1987 | [JP] | Japan | 62-236638 |
| Sep. 21, 1987 | [JP] | Japan | 62-236639 |
| Sep. 21, 1987 | [JP] | Japan | 62-144267[U] |
| Oct. 19, 1987 | [JP] | Japan | 62-263586 |

[51] Int. Cl.[4] ..... B22D 17/08; B22D 17/22

[52] U.S. Cl. ..... 164/314; 164/113; 164/312

[58] Field of Search ..... 164/312, 314, 113, 137

[56] References Cited

U.S. PATENT DOCUMENTS

| | | | |
|---|---|---|---|
| 3,791,440 | 2/1974 | Cross | 164/113 |

FOREIGN PATENT DOCUMENTS

| | | | |
|---|---|---|---|
| 44-29055 | 12/1969 | Japan . | |
| 44-31325 | 12/1969 | Japan . | |
| 47-18975 | 5/1972 | Japan . | |
| 51-34809 | 9/1976 | Japan . | |
| 55-68165 | 5/1980 | Japan | 164/312 |
| 58-55858 | 12/1983 | Japan . | |
| 59-13942 | 4/1984 | Japan . | |
| 59-30503 | 7/1984 | Japan . | |
| 60-2947 | 1/1985 | Japan . | |
| 61-255753 | 11/1986 | Japan | 164/312 |
| 62-77169 | 4/1987 | Japan | 164/312 |

*Primary Examiner*—Nicholas P. Godici
*Assistant Examiner*—J. Reed Batten, Jr.
*Attorney, Agent, or Firm*—Kanesaka and Takeuchi

[57] ABSTRACT

A casting appartaus comprises; a mold including a cavity for solidifying molten metal therein, and a runner and a biscuit portion for introducing the molten metal into the cavity; a unit removably mounted in the biscuit portion for feeding the molten metal through the biscuit portion and runner into the cavity; and a feeding rod disposed in the mold for freely protruding into the runner, and a unit for reciprocating the feeding rod. A mechanism for selecting communication and non-communication between the biscuit portion and the runner may be formed in the casting apparatus. After the molten metal is filled in the mold, the feeding rod is actuated to compress the molten metal in the mold.

24 Claims, 17 Drawing Sheets

DIE CASTING APPARATUS

FIELD OF THE INVENTION AND RELATED ART STATEMENT

The present invention relates to a casting apparatus such as a diecasting machine accompanied by the injection of molten metal for casting metal and, more particularly, to a casting apparatus having its metal feeding unit improved.

In a casting appartaus such as a diecasting machine, the molten metal is fed from a pouring unit through a biscuit portion and runner of a mold unit to a cavity, in which it is solidified into a molding.

If this molding is made for a pressure-resistive article to be made without the cavity, the cavity is pushed directly with a feeding rod after the end of the charge of the molten metal to afford the feeding effect so as to crush or disperse the cavity. This feeding effect can also be given by making the injection plunger tip of a double construction composed of an outer tip and an inner tip.

This diecasting machine is disclosed in Japanese Patent Publication Nos. 59-13942, 58-55858, 59-30503, 60-2947, 44-31325, 47-18975 and 51-34809 and Japanese Utility Model Publication No. 44-29055.

In case the cavity is to be crushed directly with the feeding rod, if the molten metal in the cavity is not solidified, the injection plunger is pushed back by the displacement of the feeding rod, so that the feeding effect cannot be given. If, on the other hand, the pushing timing is late for the direct push of the cavity, the molten metal is solidified so that the feeding rod cannot be pushed even by a considerable force. Even if pushing can be made, the molding is cracked to become defective.

In case, on the other hand, the cavity is directly pushed, the timing for starting the advance of the feeding rod has to be changed due to the condition that the mold is in a relatively cold state at the start of the casting operation or the mold is in a relatively high temperature after a series of continuous casting operations of several times. This makes it uneasy to stably provide an excellent molding because the die casting machine having a feeding rod for directly pushing the cavity is remarkably complex to operate.

In the die casting machine having the feeding rod for the direct push of the cavity, moreover, the product is partially pushed by the feeding rod, so that it has to be machined more than necessary.

In the die casting machine for giving the feeding effect by the double construction of the plunger tip of the inner and outer tips, on the other hand, the outer tip is retracted by the displacement of the advance of the inner tip to give no feeding effect if the inner tip is protruded at an early stage after the end of the charge of the molten metal, because the molten metal is not solidified to a proper level. Since, moreover, the inner tip slides on the inner circumference of the outer tip, the plunger tip has to be sufficiently cooled for preventing the seizure. For protecting the cooling portion, the plunger tip diameter and accordingly the injection cylinder diameter have to be increased more than necessary, so that the cost for constructing the apparatus rises for nothing.

There is known a castig apparatus in which the feeding effect is given by pushing the cavity or runner with the feeding rod after the end of the charge of the molten metal so as to crush the cavity of the molding and in which a cylinder mechanism is disposed in a stationary board to protrude or retract a feeding rod.

In this die casting machine of the prior art, the mounting of a stationary mold on the stationary board is obstructed by the feeding rod of the molten metal. This makes it necessary to disassemble the feeding rod itself or the assembly of the feeding rod and the feeding unit and to reassemble it after the mold has been mounted. This takes a long time to replace the mold to cause a reduction in the machine working efficiency.

OBJECTS AND SUMMARY OF THE INVENTION

The present invention has an object to provide a casting apparatus which can afford the feeding effect reliably no matter what the state of the molten metal in the mold might be. Another object of the present invention is to provide a casting machine which can make a casting of excellent quality.

A further object of the present invention is to provide a casting apparatus, in which solidified metal in a cavity, a runner and a biscuit portion is made integral so that it can be easily taken out from the mold.

A further object of the present invention is to provide a casting apparatus which can make a flawless product because what is pushed by the feeding rod is a portion outside the product. A further object of the present invention is to provide a casting apparatus which can be operated under a los casting pressure, so that it can be constructed at a low cost because the feeding effect is only required for charging the cavity.

A further object of the present invention is to provide a casting apparatus which can retract the feeding rod into the stationary board, and wherein the stationary mold is mounted and dismounted in and from the stationary board remarkably easily and promptly. A further object of the present invention is to provide a casting apparatus which can have its molding and working efficiencies remarkably improved.

According to one mode of the present invention, there is provided a casting apparatus comprising: a mold including a cavity for solidifying molten metal therein, and a runner and a biscuit portion for introducing the molten metal into said cavity; a unit removably mounted in said biscuit portion for feeding the molten metal through said biscuit portion from said runner into said cavity; a feeding rod disposed in said mold for freely protruding into said runner, and a unit for reciprocating said feeding rod; and a mechanism for selecting the communication and non-communication between said biscuit portion and said runner to allow the molten metal to flow from said biscuit portion to said runner at the time of the communication and to block the backflow from said runner to said biscuit portion at the time of non-communication.

In this mode, after the cavity has been charged up with the molten metal, the communication of the runner with the cavity is blocked by valve means, and the feeding rod is pushed into the runner to afford the feeding effect. Since, in this case, the communication between the runner and the cavity is blocked, the molten metal in the runner is prevented from flowing to the biscuit portion so that the feeding effect can be sufficiently given to the cavity.

In the aforementioned mode, said communication and non-communication selecting mechanism includes: a blocking rod capable of being freely protruded into and retracted from a communication port into said biscuit portion in said runner; and a unit for reciprocating said blocking rod to block the communication between said runner and said biscuit portion when said blocking rod is protruded and to establish the communication between said runner and said biscuit portion when the same is retracted. Here, the blocking rod can be moved back and forth by a hydraulic cylinder.

According to another mode of the present invention, a casting apparatus comprises: a mold including a cavity for solidifying molten metal therein, and a runner and a biscuit portion for introducing the molten metal into said cavity; a unit removably mounted in said biscuit portion for feeding the molten metal through said biscuit portion from said runner into said cavity; and a feeding rod disposed in said mold for freely protruding into said runner, and a unit for reciprocating said feeding rod, wherein said feeding rod is disposed to cover the communication port of said runner with said cavity at all times and to leave a gap of 0.5 to 5 mm between said communication port and said feeding rod.

In the casting apparatus of this mode, the cavity is charged up with the molten metal from the biscuit portion and the runner. At this time, the communication of the runner with the biscuit portion is arranged with the feeding rod at the predetermined gap d. As a result, heat of the molten metal in the communication port is taken by the feeding rod so that it is quickly solidified. Thus, the communication port is clogged with the solidified metal even immediately after the end of the charge of the molten metal.

If the feeding rod is moved forward after the end of the molten metal charge, the molten metal in the runner will not flow into the biscuit so that the feeding effect can be sufficiently given to the cavity no matter what the state of the molten metal in the mold might be.

In this mode, the solidified metal is commonly shared by the cavity and runner and by the biscuit portion so that it can be easily taken out, and it may require one set of a cast product pushing device.

If, in the present invention, the aforementioned gap d is larger than 5 mm, the feeding rod is excessively apart from the communication port, so that the molten metal in the vicinity of the communication port is not solidified so fast. As a result, even if the feeding rod is pushed into the runner, the molten metal in the runner flows from the communication port to the biscuit portion so that the feeding effect is dropped.

If, on the contrary, the aforementioned gap d is smaller than 0.5 mm, the flow resistance to the molten metal from the biscuit portion to the runner may become excessive to trouble the smooth charge of the molten metal. Another trouble arises in the removal of the solidified product. More specifically, the product solidified in the mold is taken out of the mold by means of a pushing device (although not shown) carried on a movable mold, for example. If, in this case, the aforementioned gap d is smaller than 0.5 mm, the solidified metal in the cavity and the runner and the solidified metal in the biscuit portion are separated, so that the solidified metal in the latter cannot be taken out. In the case of the aforementioned gap d less than 0.5 mm, therefore, another machine has to be added for removing the solidified metal from the biscuit portion, so that the cost for constructing the apparatus is raised for nothing. Moreover, the separate removal of the solifified metal will double the works.

According to a further mode of the present invention, there is provided a casting apparatus comprising: a mold including a cavity for solidifying molten metal therein, and a runner and a biscuit portion for introducing the molten metal into said cavity; a unit removably mounted in said biscuit portion for feeding the molten metal through said biscuit portion from said runner into said cavity; and a feeding rod disposed in said mold for freely protruding into said runer, and a unit for reciprocating said feeding rod, wherein said feeding rod blocks the communication of said runner with said biscuit portion when said feeding rod is protruded into said runner.

In this mode, the feeding rod is formed at its cavity side with a slope having a receiving face toward its leading end.

In the casting apparatus of this mode, the communication between the runner and the cavity is blocked if the feeding rod is pushed after the cavity has been charged up with the molten metal. As a result, the molten metal in the runner will not flow to the biscuit portion so that the feeding effect can be sufficiently given to the cavity.

Since the slope formed on the feeding rod has its normal plane directed to the cavity, it gives a high feeding pressure toward the cavity, i.e. to the molten metal in the runner, when the feeding rod advances, so that it gives a high feeding effect to the molten metal in the cavity. In other words, the advance of the feeding rod with the slope a partial pressure normal to the slope, so that it establishes a pressure to be propagated directly toward the cavity without any midway obstruction.

In the casting apparatus of any of the aforementioned modes, said mold may include: a stationary mold and a movable mold adapted to be coupled to said stationary mold, wherein said stationary mold and said movable mold define said cavity, said runner and said biscuit portion inbetween when they are coupled to each other. Likewise, said molten metal feeding unit may include: a plunger tip adapted to be reciprocated by an injection cylinder; and a sleeve fitting said plunger tip slidably therein, wherein the molten metal is injected into said mold by the forward movement of said plunger tip. Moreover, the feeding rod may preferably be reciprocated by a hydraulic cylinder mechanism and may be disposed in the stationary mold.

Since, in the present invention, a portion other than the product is pushed by the feeding rod in any of the mode, the product can be prevented from being flawed. Since, moreover, the pouring unit such as the injection cylinder need not give the feeding effect but may charge the cavity, it is sufficient with a low pouring pressure so that the cost for constructing the apparatus ca be dropped.

In the present invention, the aforementioned two or three modes may be combined.

According to the present invention, there is provided a casting apparatus comprising: a stationary mold and a movable mold capable of being coupled to said stationary mold for forming a space for molten metal inbetween when said molds are coupled to each other; a stationary board attached to said stationary mold; a movable board carrying said movable mold; a moving unit for moving said movable board to couple or uncouple said movable mold and said stationary mold; a feeding rod disposed to extend through said stationary mold and capable of being protruded into said space for the molten metal; and a mechanism disposed in said stationary board for moving said feeding rod back and forth to retract said feeding rod into said stationary board, wherein said means for moving said feeding rod back and forth has no member connected in said stationary mold in the state in which said feeding rod is retracted into said stationary board, so that said stationary mold can be freely mounted and demounted in said state in said stationary board independently of said moving means.

The mechanism for moving the feeding rod back and forth has no member connected in the stationary mold in the state, in which the feeding rod is retracted into the stationary board, so that the stationary mold can be freely mounted in or demounted from the stationary board in that state.

In the casting apparatus of the present invention, the feeding rod can be accommodated inside from the mold mounting face of the stationary mold to raise no obstruction when the mold is mounted or demounted. Incidentally, after the mounting of the mold, the feeding operation can be accomplished like the prior art by protruding the feeding rod into the casting space by the cylinder mechanism. According to the present invention, it is remarkably easy and prompt to mount or demount the stationary mold in or from the stationary board. Thus, the molding efficiency can be remarkably improved.

According to the present invention, said unit for moving said feeding rod back and forth may include: a cylinder bore formed in said stationary board; and a piston fitted in said cylinder bore.

According to the present invention, said unit means for moving said feeding rod back and forth may be a multiple cylinder mechanism. By this multiple cylinder mechanism, said feeding rod can be moved back and forth by said cylinder mechanism to take three positions: a position in which said feeding rod is protruded into said casting space; a position in which said feeding rod is retracted into said stationary mold; and a position in which said feeding rod is retracted into said stationary board.

Said feeding rod may preferably be protruded into a runner in said space for the molten metal. The casting apparatus of the present invention may further comprises a unit for injecting the molten metal into said space for the same.

This molten metal feeding unit includes: a plunger tip adapted to be reciprocated by an injection cylinder; and a sleeve fitting said plunger tip slidably therein, wherein the molten metal is injected into said mold by the forward movement of said plunger tip.

The mechanism for moving said feeding rod back and forth may include: a cylinder bore formed in said stationary board; a piston filled in said cylinder bore and connected to said feeding rod directly or indirectly through a suitable connecting member; and a mechanism for adjusting the retraction limit of said piston. This mechanism for adjusting the retraction limit may include: a head cover disposed in said stationary board and having an internally threaded bore extending from said cylinder bore; and a retraction limit adjusting member formed on its outer circumference with an external thread meshing with the internal thread of said head cover and having its leading end inserted into said cylinder bore and its trailing end protruded through said head cover to the outside, said member being moved forward, when its protruded portion is turned, by the engagement between said external thread and said internal thread to change the position thereof in the axial direction of said cylinder bore so that the retraction limit of said piston by the abutment of said piston against the leading end of said member.

PREFERRED EMBODIMENTS

The present invention will be described in detail in the following in connection with the embodiments thereof with reference to the accompanying drawings.

Figure 1:
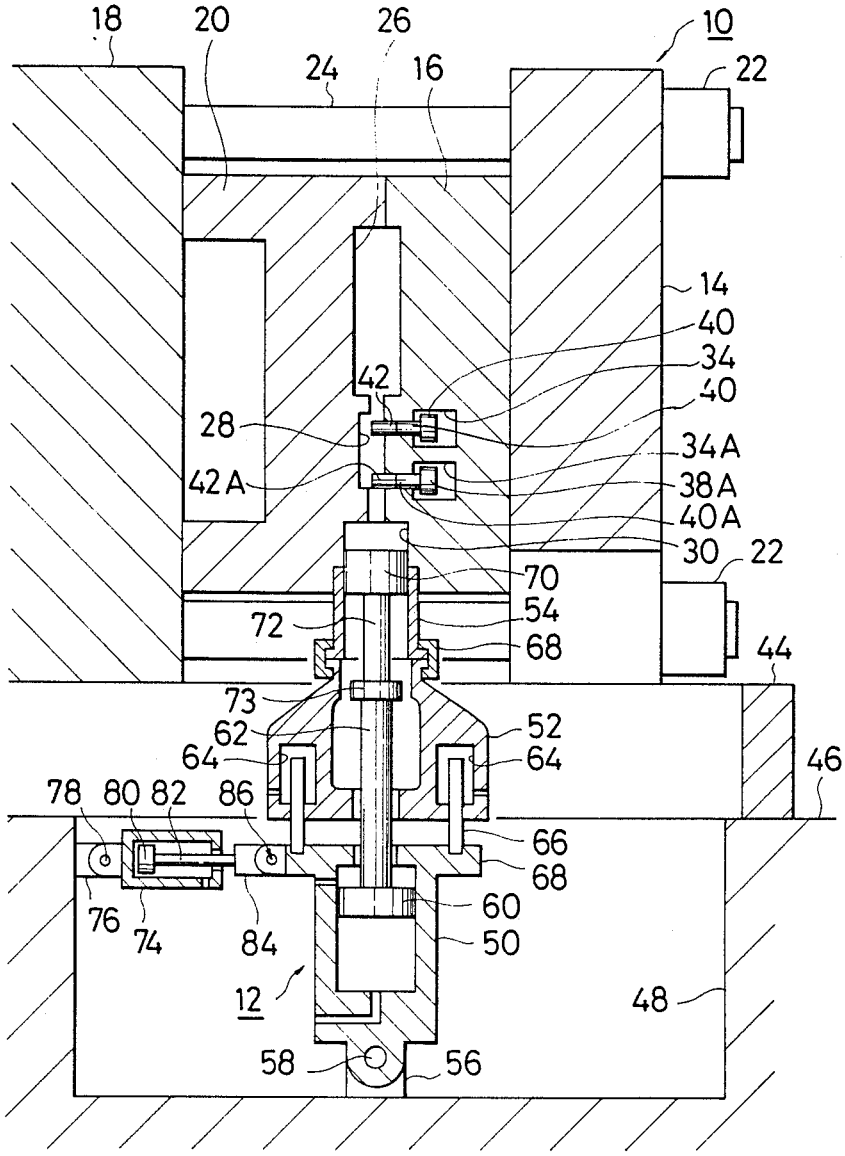
FIG. 1 is a vertical section showing a casting apparatus according to an embodiment of the present invention.

FIG. 1 is a vertical section showing a casting apparatus according to an embodiment of the present invention. This casing apparatus is constructed mainly of a molding unit 10 and a pouring unit 12. The molding unit 10 is equipped with a stationary mold 16 held on a stationary board 14 and a movable mold 20 held on a movable board 18. The stationary board 15 has a column 24 connected thereto through nuts 22, and the movable board 18 is made movable toward and apart from the stationary board 14 along the column 24 by the action of a not-shown toggle mechanism.

The stationary mold 16 and the movable mold 20 is formed in its mating faces with a cavity 26, a runner 28 and a biscuit portion 30.

The stationary mold 16 is formed with cylinder bores 34 and 34A, in which are reciprocated pistons 38 and 38A, respectively. To these pistons 38 and 38A, there are connected the rear ends of a feeding rod 42 and a closing rod 42a, respectively, through piston rods 40 and 40A so that the feeding rod 42 and the closing rod 42A can protrude into the runner 28. The closing rod 42A can block the communication port of the runner 28 with the biscuit portion 30 when it protrudes.

The molding unit 10 is placed on a machine base 44, which in turn is disposed to cross a pit 48 formed by recessing a ground base 46.

The pouring unit 12 is disposed in the pit 48. This pouring unit 12 is constructed of an injection cylinder 50, a block, 52 and a sleeve 54 sequentially upward in the recited order. The injection cylinder 50 is hinged through a pin 58 to a seat 56, which is anchored to the bottom of the pit 48, so that its upper end can be inclined on the pin 58. In the injection cylinder 50, there is reciprocated a piston 60 to which is connected an upwardly extending rod 62.

The block 52 is formed with vertically extending cylinder bores 64, into which are inserted docking rams 66 having their lower ends anchored to a flange 68 formed on the top surface of the injection cylinder 50.

The sleeve 54 is connected through a connecting member 68 to the upper side of the block 52 and has its upper end fitted in the lower end of the biscuit portion 30 of the molding unit 10. In the sleeve 54, there is slidably fitted a plunger tip 70 which is held by a plunger 72. This plunger 72 has its lower end connected to the upper end of the rod 62 through a coupling 73.

To the side wall of the pit 48, there is hinged through a seat 76 and a pin 78 an inclining cylinder 74 which has its piston 80 connected to a rod 82. This rod 82 has its leading end hinged to the side of the flange 68 of the injection cylinder 50 through a coupling 84 and a pin 86.

The operations of the casting apparatus thus constructed will be described in the following with reference to FIGS. 2 to 4.

When the oil pressure is released from the cylinder bores 64, the block 52 drops until it seats upon the cylinder 50. When, on the other hand, the oil pressure is released from the head end of the injection cylinder 50, the piston 60 drops together with the plunger tip 70 to their lower limits. If, in this position, the rod 82 of the inclining cylinder 74 is protruded, the pouring unit 12 is inclined in its entirety. Then, a molten metal is poured into the sleeve 54.

After this, the rod 82 of the inclining cylinder 74 is retracted to return the pouring unit 12 to the upright position. Next, the oil pressure is introduced into the cylinder bores 64 of the block 52 to protrude the docking rams 66. As a result, the block 52 is raised to insert the sleeve 54 into the biscuit portion 30 of the molding unit 10.

Then, the oil pressure is introduced into the head-end side of the injection cylinder 50 to raise the piston 60. As a result, the plunger tip 70 is raised to introduce the molten metal reserved in the sleve 54 into the cavity 26 through the biscuit portion 30 and the runner 28.

Figure 2:
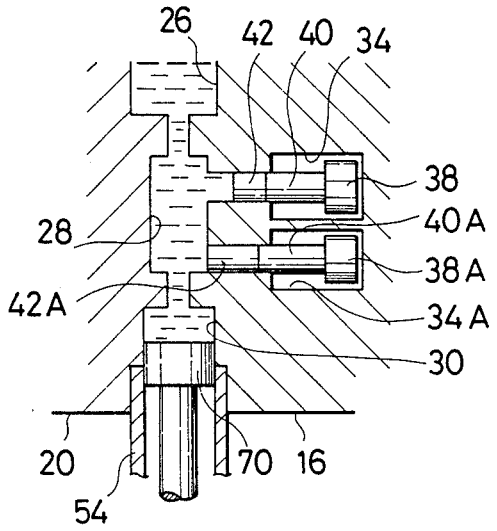
FIGS. 2, 3 and 4 are views for explaining the operations of the casting apparatus of FIG. 1.
Figure 3:
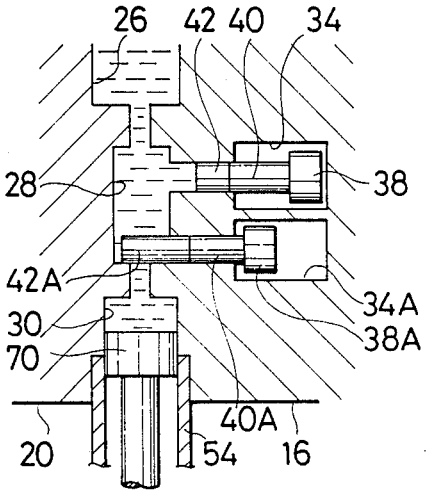
Figure 4:
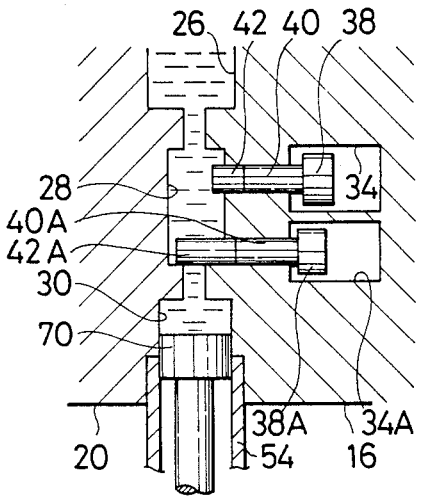

After the cavity 26 is fully charged up with the molten metal, as shown in FIG. 2–4, the oil pressure is introduced into the head-end side chamber of the cylinder bore 34A, as shown in Fig, 3, to move forward the piston 38A and the closing rod 42A connected to the former, thereby to block the communication between the runner 28 and the biscuit portion 30. After this, as shown in FIG. 4, the oil pressure is introduced into the head-end side chamber of the cylinder bore 34 to move the piston 38 forward thereby to force the feeding rod 42 connected thereto into the runner 28. Since the molten metal in the runner 28 has its release passage closed by the closing rod 42A, the pressure from the feeding rod 42 is wholly transmitted to the cavity 26 so that a reliable pouring effect can be attained.

After the solidification of the molten metal in the cavity has ended, the movable board 18 is retracted to open the mold, and the cast product is pushed out by a pushing device (although not shown) which is carried on the movable mold 20.

Incidentally, prior to this mold opening step, the piston 60, the block 52 and so on are dropped to their lower limits and prepared for the subsequent casting process.

In the embodiment described above, the closing rod 42A constitutes means for blocking the communication between the runner 28 and the biscuit portion 30, but the blocking means may be exemplified in the present invention by a variety of other valve mechanisms.

Figure 5:
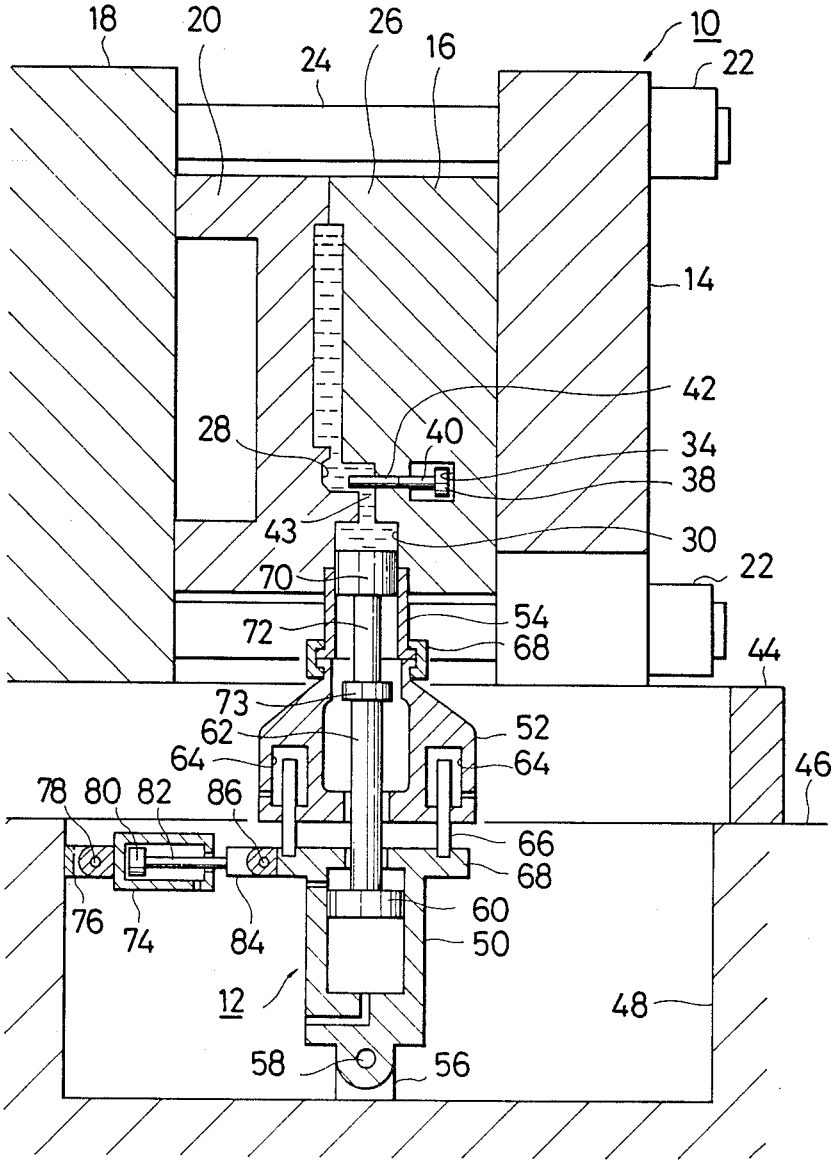
FIG. 5 is a vertical section showing a casting apparatus according to another embodiment of the present invention.
Figure 6:
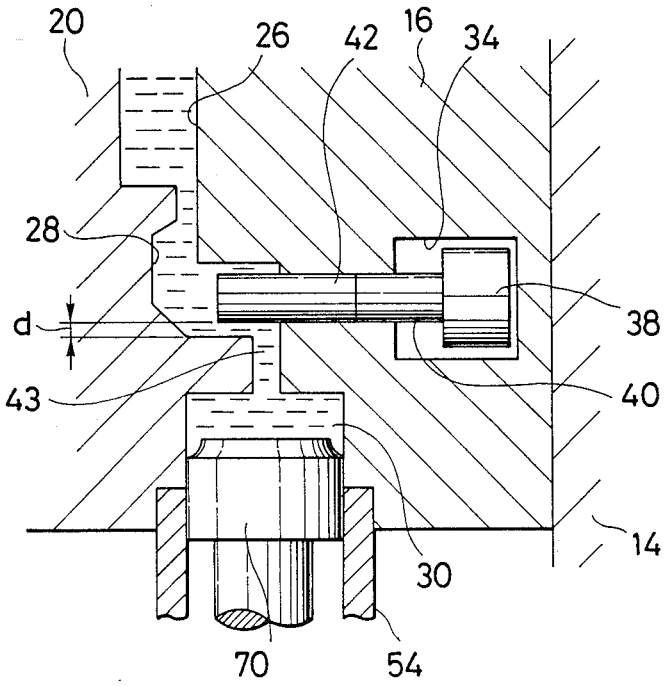
FIG. 6 is an enlarged view showing the essential portion of the same.

FIG. 5 is a vertical section showing a casting apparatus according to another embodiment of the present invention, and FIG. 6 is an enlarged view showing the essential portion of the same.

The stationary mold 16 is formed with the cylinder bore 34 in which is fitted the piston 38. This piston 38 is connected through the piston rod 40 to the feeding rod 42, which can protrude into the runner 28. The feeding rod 42 is disposed to cover a communication port 43 of the runner 28 with the biscuit portion 30 and to leave a gap d of 0.5 to 5 mm between the communication port 43 and the feeding rod 42 whichever is might take a protruding or retracted position.

The remaining construction is similar to that of FIGS. 1 and 2, and the common members are designated at the common reference numerals. In this casting apparatus, the molten metal in the cavity 26 is introduced into the same procedures as those of the apparatus of FIGS. 1 and 2. Therefore, the description to be made in the following is directed mainly to a method of giving the feeding effect to the molten metal in the cavity.

After the cavity 26 is fully charged up with the molten metal, the oil pressure is introduced into the head-end chamber of the cylinder bore 34 to move forward the piston 38 and the feeding rod 42 connected to the former. In the communication port 43 of the runner 28 with the biscuit portion 30, there is so arranged the feeding rod 42 as to cover the communication port 43 while leaving the predetermined gap d. In the portion of the communication port 43, therefore, heat of the molten metal is taken by the feeding rod 42, so that it is quickly solidified. As a result, the communication port 43 is clogged with the solidified metal even immediately after the end of charge of the molten metal.

If the feeding rod is pushed forward after the end of the molten metal charge, the molten metal in the runner 28 has its retreat locked by the feeding rod 42, so that the pressure from the feeding rod 42 is wholly applied to the inside of the cavity 26 to provide a reliable feeding effect.

After the molten metal in the cavity 26 has been solidified, as in the apparatus of FIG. 1 and 2, the movable board 18 is retracted to open the mold, and the product is removed by the pushing device (although not shown) carried on the movable mold 20.

Figure 7:
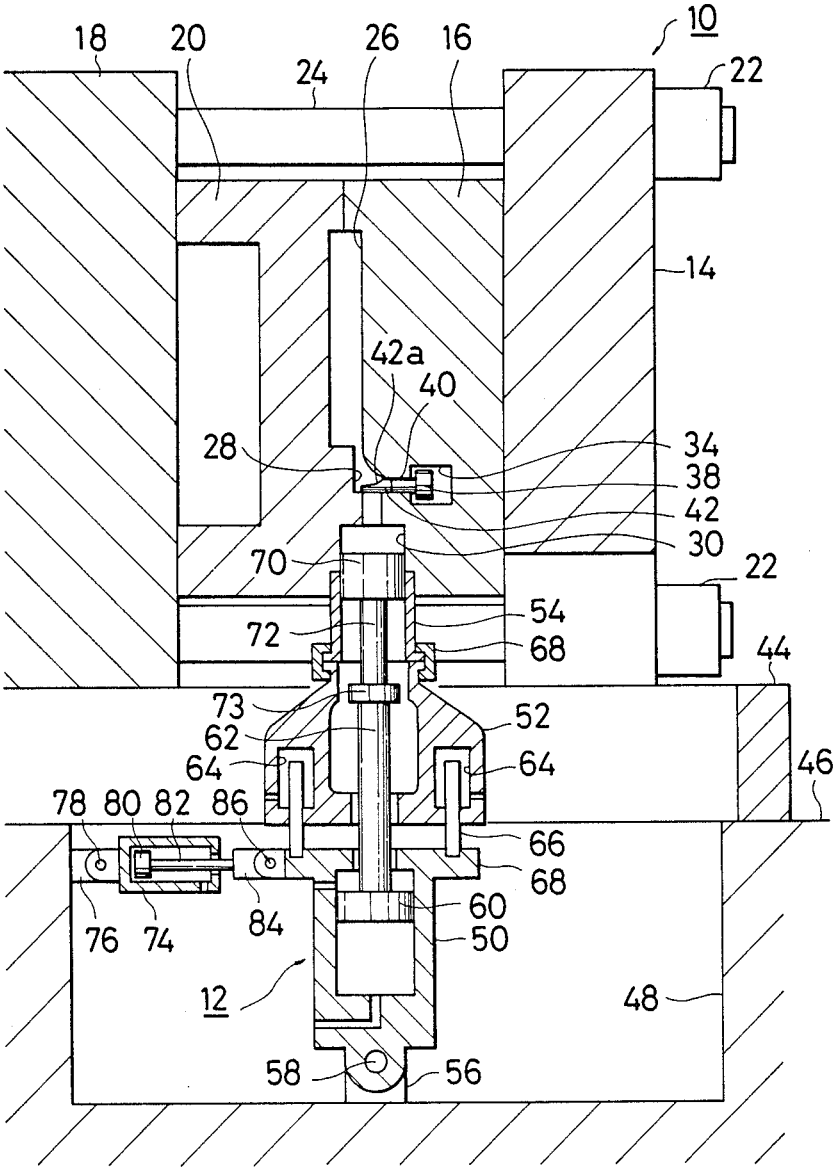
FIG. 7 is a vertical section showing a casting apparatus according to a further embodiment of the present invention.
Figure 8:
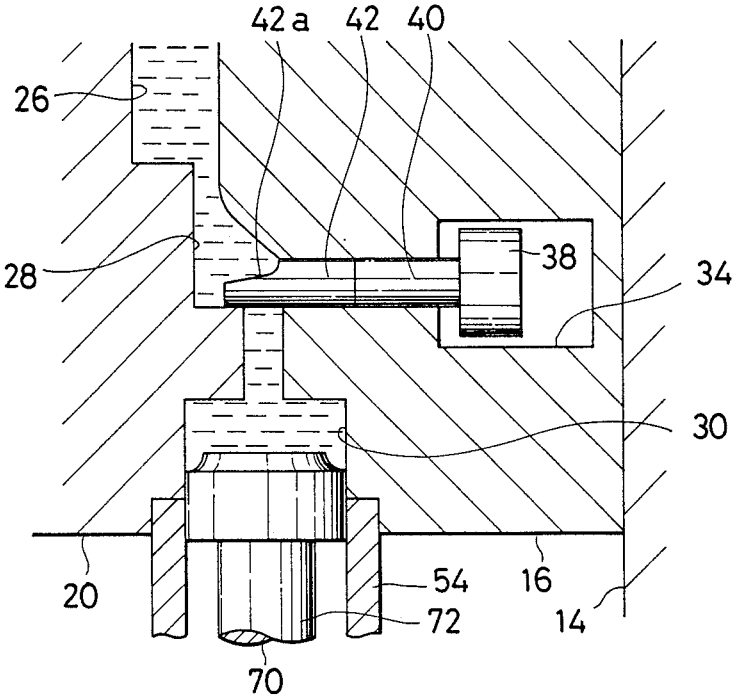
FIG. 8 is an enlarged view showing the essential portion of the same.

FIG. 7 is a vertical section showing the casting apparatus according to still another embodiment of the present invention, and FIG. 8 is an enlarged view showing the essential portion of the same.

The stationary mold 16 is formed with the cylinder bore 34, in which is fitted the piston 38. This piston 38 is connected through the piston rod 40 to the feeding rod 42, which can protrude into the runner 28. The feeding rod 42 can block the communication port of the runner 28 with the biscuit portion 30 when it is protruded. Moreover, the feeding rod 42 has its upper face formed with a downhill slope **42*a*** which is sloped downhill toward the leading end.

The remaining construction is similar to that of FIGS. 1 and 2, and the common members are designated at the common reference numerals. In this casting apparatus, the molten metal in the cavity 26 is introduced into the same procedures as those of the apparatus of FIGS. 1 and 2. Therefore, the description to be made in the following is directed mainly to a method of giving the feeding effect to the molten metal in the cavity.

After the cavity 26 has been fully charged up with the molten metal, the oil pressure is introduced into the head-end chamber of the cylinder bore 34 to move forward the piston 38 and the feeding rod 42 connected to the former, thereby to block the communication port between the runner 28 and the biscuit portion 30. By moving the piston 38 further, the feeding rod 42 is pushed deep into the runner 28. Since the molten metal in the runner 28 has its retreat blocked by the feeding rod 42, the pressure from the feeding rod 42 is wholly transmitted to the inside of the cavity 26 to provide a reliable feeding effect.

In the embodiment described above, the feeding rod 42 has its upper face formed with the downhill slope 42*a* which is directed toward the cavity 26. As a result, a high feeding pressure is established toward the cavity 26, when the feeding rod 42 is pushed, to feed the molten metal effectively.

After the molten metal in the cavity 26 has been solidified, the movable board 18 is retracted to open the mold, and the cast product is extruded by the pushing device (although not shown) carried on the movable mold 20.

Figure 9:
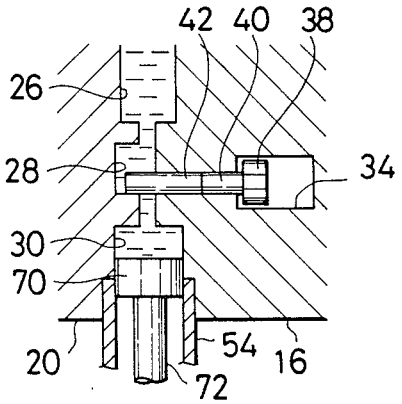
FIG. 9 is a section showing the essential portion of a casting apparatus according to a further embodiment of the present invention.

In the embodiment of FIGS. 7 and 8, the feeding rod 42 is formed with the downhill slope 42*a*. According to the present mode, the feeding rod may be sufficient if it can block the retreat of the molten metal and can be exemplified by the feeding rod having no slope, as shown in FIG. 9. Incidentally, the remaining construction of FIG. 9 is similar to that of FIG. 8, and the common portions are designated at the common reference numerals.

All the embodiments are made by the horizontal clamping mold and the vertical casting apparatus. Despite of this fact, however, the present invention can be applied in all the modes to the injection casting apparatus having various molds and pouring units.

Figure 10:
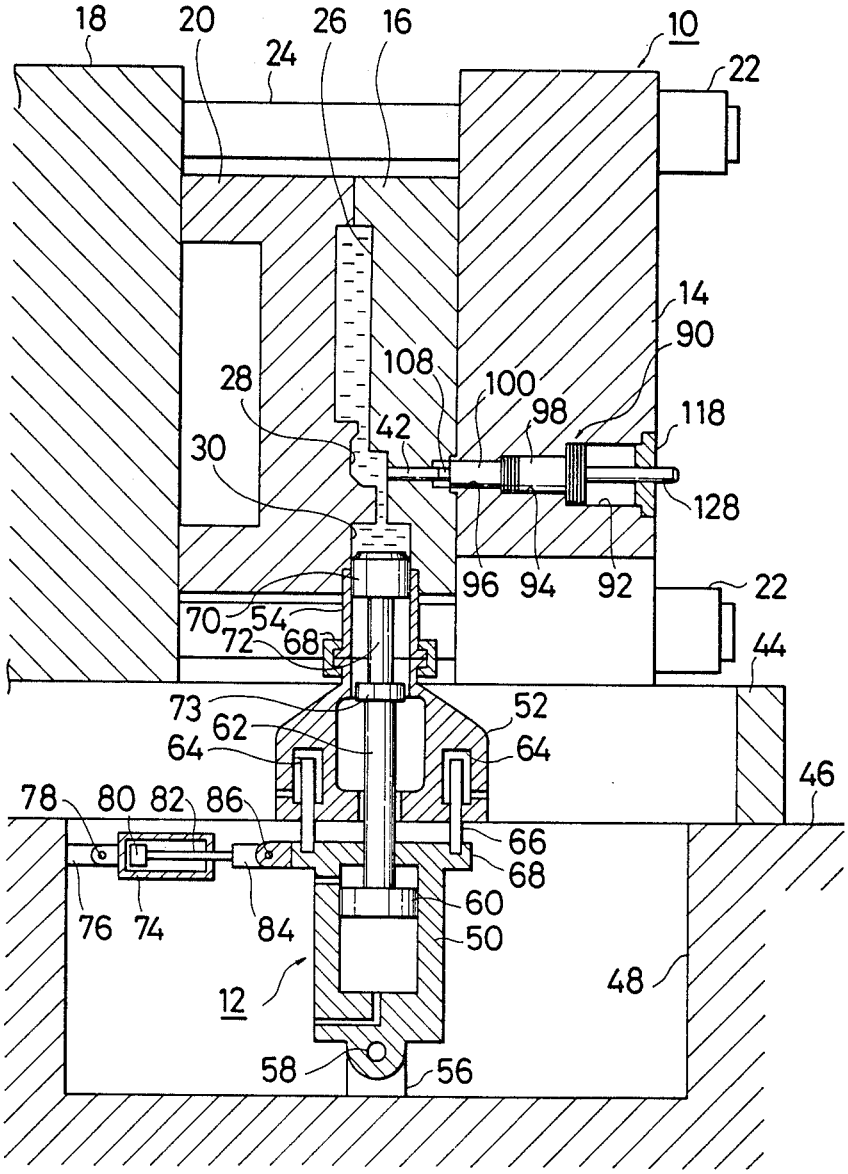
FIG. 10 is a vertical section showing a casting apparatus according to a further embodiment of the present invention.
Figure 11:
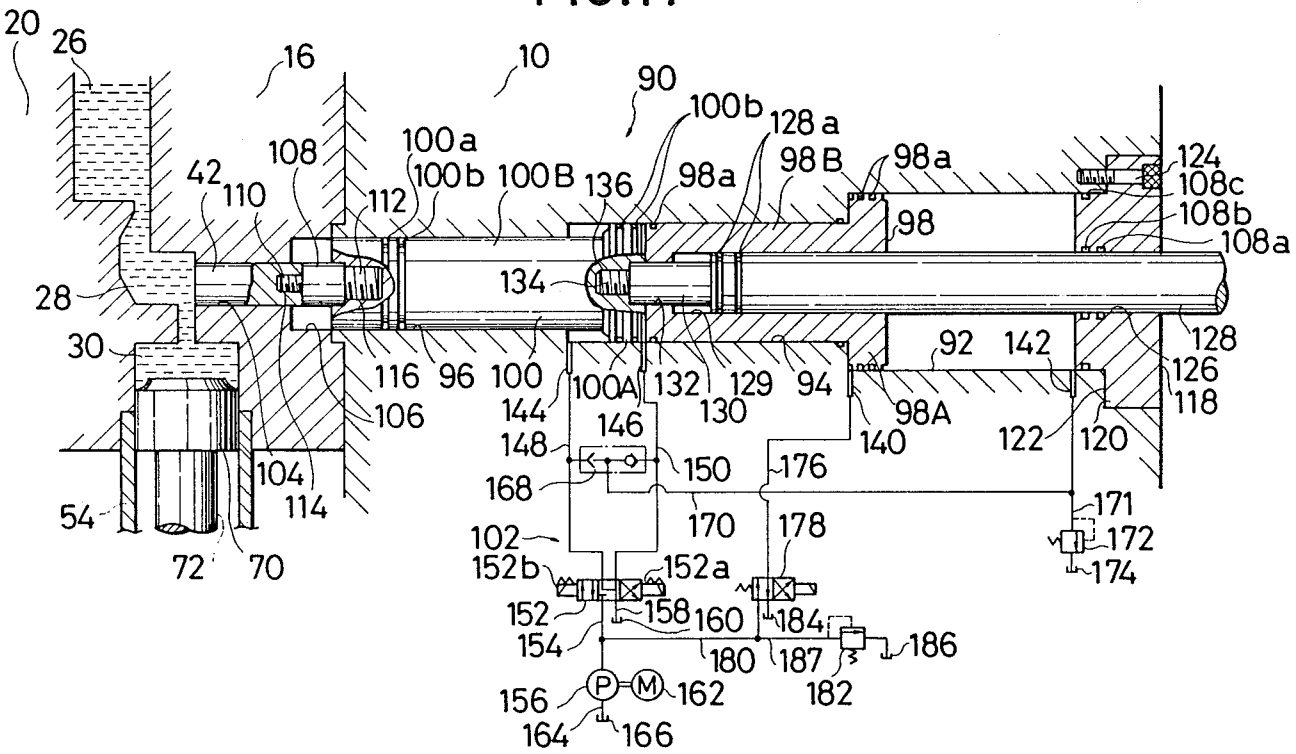
FIG. 11 is an enlarged view showing the essential portion of the same.
Figure 12:
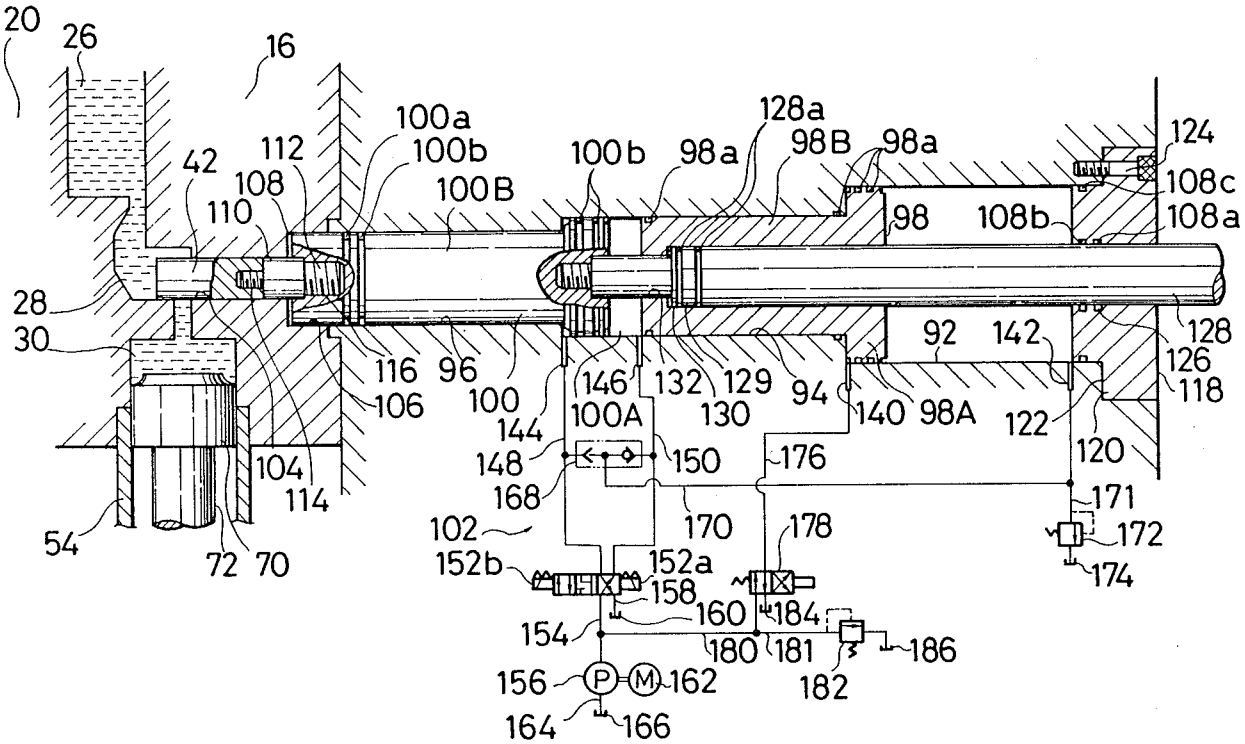
FIGS. 12, 13 and 14 are views for explaining the operations.
Figure 13:
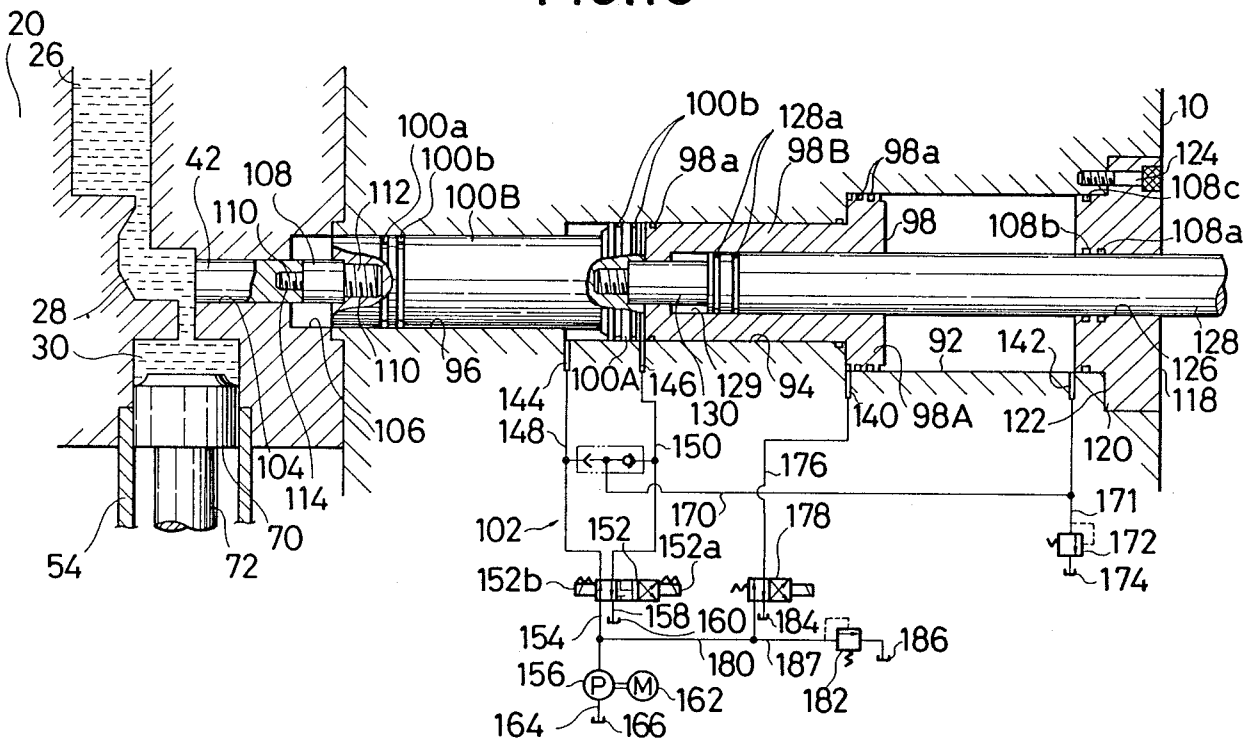
Figure 14:
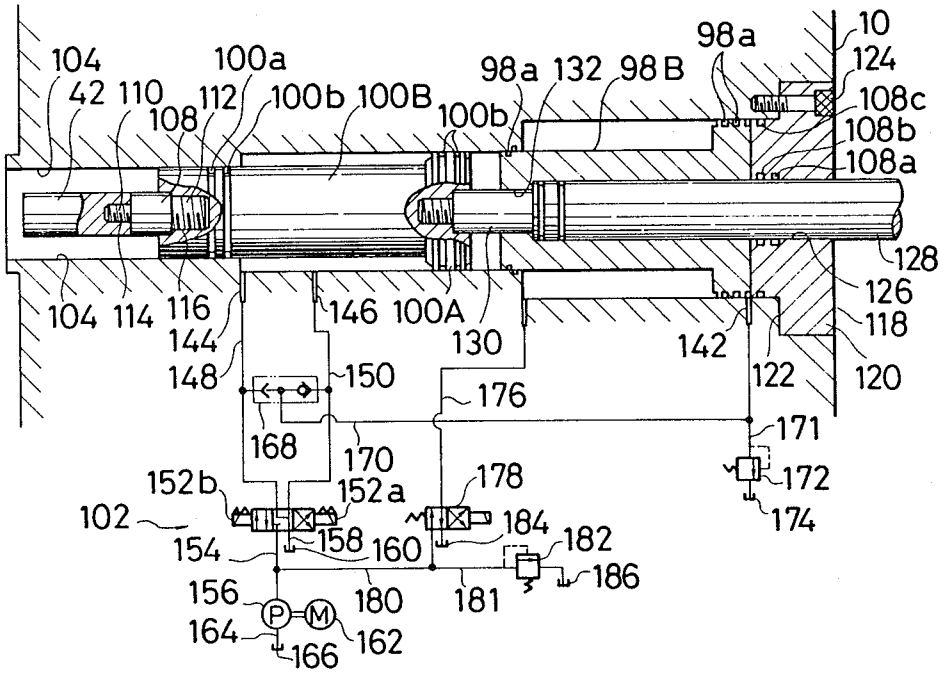

FIG. 10 is a vertical section showing the casting apparatus according to a further embodiment of the present invention; FIG. 11 is an enlarged view showing the essential portion of the same; and FIGS. 12 to 14 are views for explaining the operations.

The stationary board 10 is equipped with a multiple cylinder mechanism 90, by which is moved back and forth the feeding rod 42 into the runner 28. The cylinder mechanism 90 is constructed of: larger, intermediate and smaller cylinder bores 92, 94 and 96 formed continuously in the stationary board 10; a feeding rod fitting piston 98 having a larger diameter; a feeding piston 100 having an intermediate diameter; and a hydraulic circuit 102.

The feeding rod fitting piston 98 is composed of a piston portion 98A having a larger diameter and a cylinder portion 98B having a smaller diameter. The piston portion 98A slides on the inner circumference of the larger-diameter cylinder bore 92, whereas the cylinder portion 98B slides on the inner circumference of the intermediate-diameter cylinder bore 94.

On the other hand, the feeding piston 100 is composed of a piston portion 100A having a larger diameter and a solid plunger portion 100B having a smaller diameter. The piston portion slides on the inner circumference of the intermediate-diameter cylinder bore, whereas the plunger portion 100B slides on the inner circumference of the smaller-diameter cylinder bore 96.

Designated at reference numeral 104 is a bore for the feeding rod 42, which is formed in the stationary mold 16. The bore 104 is enlarged, as indicated at 106, at the side of the stationary board 10 for receiving the protrusion of the feeding piston 100. Designated at numeral 108 is a connectig member which connects the feeding rod 42 and the feeding piston 100. The connecting member 108 is formed at its two ends with external threads 110 and 112, which are screwed in internal threads 114 and 116 formed at the trailing end of the feeding rod 42 and the leading end of the feeding piston 100, respectively. Designated at numeral 118 is a cap which is fitted in the cylinder bore 92. The cap 118 has its flange 120 formed at its circumferential edge. This flange 120 is engaged by a step 122, which is formed at the stationary board 10, and is fastened by means of bolts 124. The cap 118 is formed with a center bore 126, into which is inserted a pull rod 128. This pull rod 128 has its leading end portion fitted slidably in the center bore 129 of the feeding rod fitting piston 98. The pull rod 128 has its further leading end reduced, as at 130, and this reduced portion 130 is inserted into the opening 132 which is formed in the leading end wall of the feeding rod fitting piston 98. The pull rod 128 has its foremost end formed with an external thread 134 which is screwed in an internal thread 136 formed in the trailing end of the feeding piston 100.

A U-packing 98*a* is fitted around the feeding rod fitting piston 98, and an O-ring 100*a* and a U-packing 100*b* are fitted around the feeding piston 100. An O-ring 108*a* and a U-packing 108*b* are fitted in the inner circumference of the center bore 126 of the cap 108, and an O-ring 108*c* is wound around the outer circumference of the cap 108.

Next, the construction of the hydraulic circuit 102 will be described in the following.

The larger-diameter piston bore 92 is formed at its innermost portion with a hydraulic port 140 and at its side of the cap 118 with a hydraulic port 142. On the other hand, the intermediate-diameter cylinder bore 94 is formed in its deepest portion with a hydraulic port 144 and midway thereof with a hydraulic port 146. Incidentally, this hydraulic port 146 is disposed at the mating portion between the trailing end of the feeding piston 100 and the feeding rod fitting piston 98 when the feeding rod 42 is retracted into the bore 104 of the stationary mold 16, as shown in FIG. 11.

Those hydraulic ports 144 and 146 are connected through hydraulic lines 148 and 150, respectively, to an electromagnetic four-way valve 152. This electromagnetic four-way valve is a pump-closed center type four-port three-position change-over valve having solenoids 152*a* and 152*b* at its two ends and a spring at its center. The four-way valve 152 is connected through a line 154 to a hydraulic pump 156 and through a line 158 to an oil tank 160. The pump 156 is equipped with a drive motor 162 and connected through a line 164 to an oil tank 166.

Between the hydraulic lines 148 and 150, there is connected a shuttle valve 168 which has its respective inlet ports connected of the hydraulic lines 148 and 150. The discharge port of the shuttle valve 168 is connected through a line 170 to the aforementioned port 142. A relief valve 172 is connected through a line 171 to the midway of the hydraulic line 170. Reference numeral 174 designates an oil tank.

The hydraulic port 140 is connected through a hydraulic line 176, an electromagnetic four-way valve 178 and a hydraulic line 180 to the hydraulic pump 156. The electromagnetic four-way valve 178 is a spring offset type four-port two-position change-over valve having one solenoid. A relief valve 182 is connected through a line 181 to the midway of the line 180. Reference numerals 184 and 186 designate individual oil tanks. The remaining construction of the casting apparatus is similar to those of the foregoing embodiments, and the common members are designated at the common reference numerals.

The operations of the casting apparatus thus constructed will be described in the following.

If the oil pressure is released from the inside of the cylinder bore 64, the block 52 is dropped until it is seated on the injection cylinder 50. If, on the other hand, the oil pressure is released from the head-end side of the cylinder 50, the piston 60 is dropped to its lower extremity, and the plunger tip 70 is also dropped to its lower extremity. If, in this state, the rod 82 of the inclining cylinder 74 is protruded, the pouring unit 12 is inclined as a whole. Then, the molten metal is poured into the sleeve 54.

After this, the rod 82 of the inclining cylinder 74 is retracted to bring the pouring unit 12 into the vertical position. Next, the oil pressure is introduced into the cylinder bore 64 of the block 52 to protrude the docking rams 66. As a result, the block 52 is raised to insert the sleeve 54 into the biscuit portion 30 of the molding unit 10.

Then, the oil pressure is introduced into the head-end chamber of the injection cylinder 50 to raise the piston 60. As a result, the plunger tip 70 is raised to introduce the molten metal from the sleeve 54 through the biscuit portion 30 and the runner 28 into the cavity 26.

After the cavity 26 has been completely charged up with the molten metal, the multiple cylinder mechanism 90 can be actuated to move the feeding rod 42 forward to provide the feeding effect.

After the solidification of the molten metal in the cavity 26, the movable board 18 is retracted to open the mold thereby to take out the cast product by the pushing device (although not shown) carried on the movable mold 20.

Incidentally, prior to this mold opening step, the piston 60 and the block 52 have been dropped to their lower extremities and are prepared for the subsequent casting operation.

Next, the operations of the multiple cylinder mechanism 90 and the hydraulic circuit 102 will be described in the following.

If, in the state shown in FIG. 11, the solenoid 152*a* of the electromagnetic four-way valve 152 is energized, the communication between the hydraulic lines 154 and 150 is established, as shown in FIG. 12, to introduce the oil pressure from the hydraulic pump 156 through the hydraulic port 146 into the cylinder bore 94 thereby to push and move the feeding piston 100 forward. As a result, the feeding rod 42 is protruded into the runner 28. Since, at this time, the hydraulic line 150 takes a higher pressure than that of the hydraulic line 148, the shuttle valve 168 provides the communication between the hydraulic lines 150 and 170 so that the oil pressure from the hydraulic pump 156 is also introduced through the hydraulic port 142 into the cylinder bore 92 to urge the feeding rod fitting piston 98 leftwardly of the drawing. As a result, the feeding rod fitting piston 98 is held in its deepest position, as shown in FIG. 12.

Next, the solenoid 152*b* of the electromagnetic four-way valve 152 is energized so as to retract the feeding rod 42 from the feeding state into the stationary mold 16. As a result, the communication between the hydraulic lines 148 and 154 is established to introduce the oil pressure of the hydraulic pump 156 from the hydraulic port 144 into the cylinder bore 94. This oil pressure pushes the piston portion 100A of the feeding piston 100 rightwardly of the drawing to retract the feeding rod 42 into the bore 104 of the stationary mold 16. At this time, the oil pressure in the righthand chamber of the piston portion 100A is released through the port 146 and the lines 150 and 158 into the oil tank 160. In the state of FIG. 13, moreover, the hydraulic line 148 is under a higher pressure than the hydraulic line 150 so that the oil pressure in the hydraulic line 148 is introduced through the shuttle valve 168, the hydraulic line 170 and the port 142 into the cylinder bore 92 to urge the feeding rod fitting piston 98 leftwardly of the drawing. As a result, the feeding rod fitting piston 98 is maintained in its deepest position.

In case the stationary mold 16 is to be removed from the stationary board 14, the feeding rod 42 is retracted into the stationary board 14. For this retraction, as shown in FIG. 14, the electromagnetic four-way valve 178 is energized to establish the communication between the hydraulic lines 176 and 180. On the other hand, the electromagnetic four-way valve 152 deenergizes both the solenoids 152*a* and 152*b*. Then, the oil pressure of the hydraulic pump 156 is introduced through the hydraulic port 140 into the cylinder bore 92 to push the piston portion 98A of the feeding rod fitting piston 98 thereby to move the feeding rod fitting piston 98 rightwardly of the drawing. If this fitting piston 98 is moved rightwardly, the pull rod 128 is also moved rightwardly of the drawing while being pulled by the feeding rod fitting piston 98 so that the feeding piston 100 connected to the leading end of the pull rod 128 is also moved rightwardly of the drawing. As a result, the feeding rod 42 is further moved rightward from the position of FIG. 13 until it is retracted into the stationary board 14 (or the cylinder bore 96), as shown in FIG. 14. Thus, the feeding rod 42 is not protruded in the least from the stationary board 14 so that the stationary mold 16 can be mounted and demounted remarkably easily and promptly.

Figure 15:
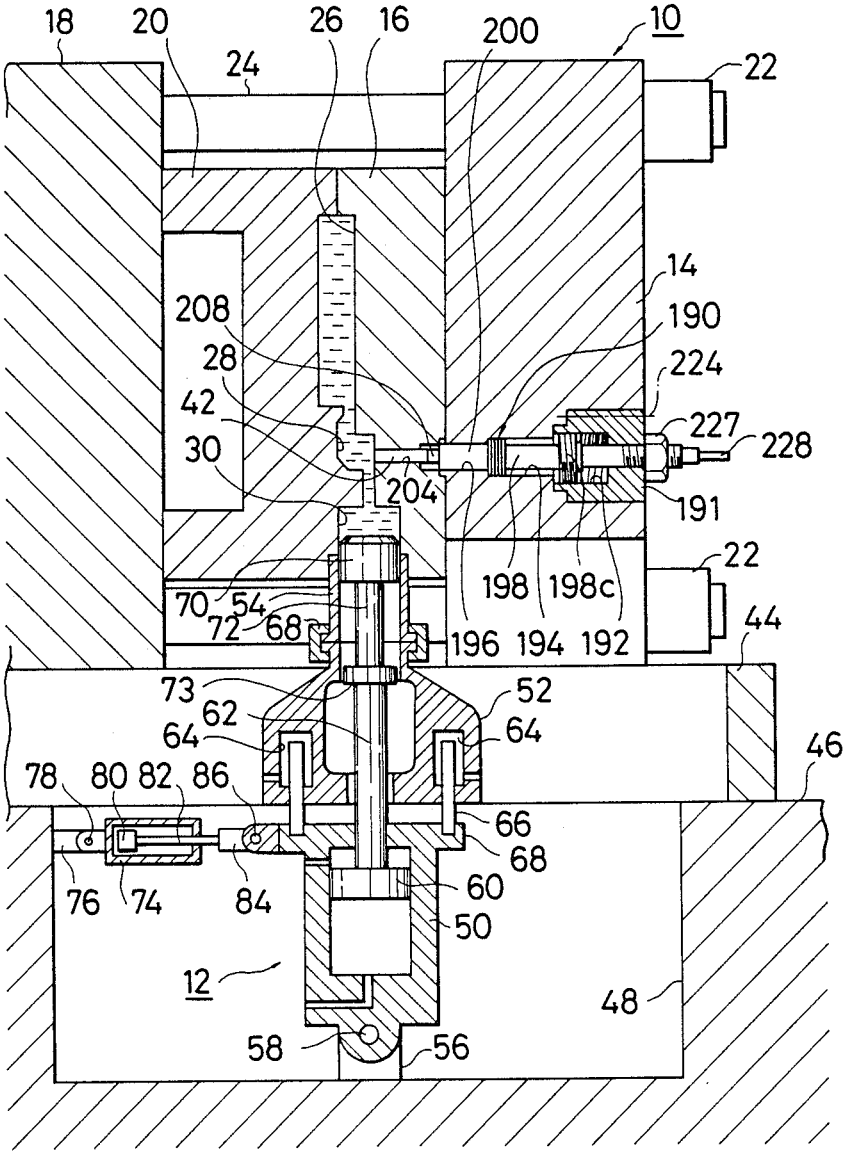
FIG. 15 is a vertical section showing a casting apparatus according to a further embodiment of the present invention.
Figure 16:
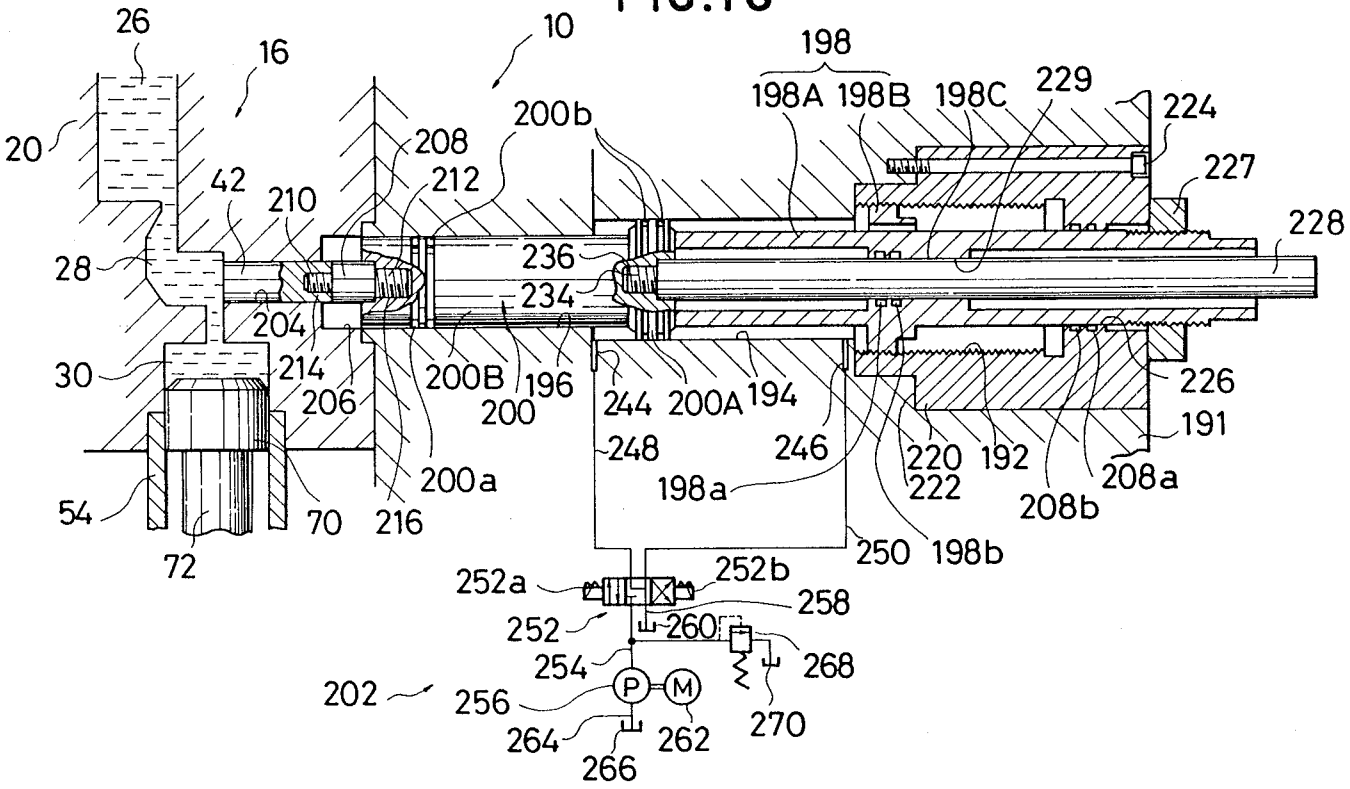
FIG. 16 is an enlarged view showing the essential portion of the same.

FIG. 15 is a vertical section showing a casting apparatus according to a further embodiment of the present invention; FIG. 16 is an enlarged view showing the essential portion of the same; and FIGS. 17 to 20 are views for explaining the operations of the same.

The stationary board 14 is equipped with a cylinder mechanism 190, by which is moved back and forth the feeding rod 42 into the runner 28. The cylinder mechanism 190 is constructed of: a head cover 191 having a larger-diameter cylinder bore 192; intermediate- and smaller-diameter cylinder bores 194 and 196 formed continuously in the stationary board 14 coaxially with the cylinder bore 192; a retraction limit adjusting member (which will be shortly referred to as an "adjusting member") for adjusting the retraction limit of a later-desribed piston 200; and the feeding piston 200; and a hydraulic circuit 202. The larger-diameter cylinder bore 192 is formed with an internal thread in its inner circumference.

The adjusting member 198 is equipped with a hollow column portion 198A and a nut portion 198B which is formed to project in a flange shape from the outer circumference of the columnn portion 198A and formed with an external thread on its outer circumference. The nut portion 198B is screwed in the internal thread formed in the inner circumference of the cylinder bore 192 so that the adjusting member 198 can be moved back and forth in the axial direction of the cylinder bore 192 by turning it forward and backward on its axis.

On the other hand, the feeding piston 200 is formed of a larger-diameter piston portion 200A and a smaller-diameter solid plunger portion 200B. The piston portion 200A slides on the inner circumference of the intermediate-diameter cylinder bore 194, whereas the plunger portion 200B slides on the inner circumference of the smaller-diameter cylinder bore 196.

Designated at reference numeral 204 is a bore for the feeding rod 42, which is formed in the stationary mold 16. The bore 204 is enlarged, as designated at 206, at its side of the stationary board 14 so as to receive the protrusion of the feeding piston 200. Designated at numeral 208 is a connector for connecting the feeding rod 42 and the feeding piston 200. The connector 208 is formed at its two ends with external threads 210 and 212, which are screwed in internal threads 214 and 216 formed at the trailing end of the feeding rod 42 and the at the leading end of the feeding piston 200, respectively.

The head cover 191 is formed on its circumferential edge with a flange 220 which engages with a step 222 formed on the stationary board 14. The head cover 191 is fastened to the stationary board 14 by means of bolts 224 which extend through the flange 220. This head cover 191 is formed with a center bore 226, into which is inserted the column portion 198A of the adjusting member 198. This column portion **198*a* of the adjusting member 198. This column portion forms an actuating shaft for turning the adjusting member 198 and has its one end extending through the center bore 226 to the outside of the cylinder bore 192. The column portion 198A is formed with an external thread, which is screwed by a lock nut 227**.

Into the column portion 198A, there is inserted a guide rod 228. This guide rod 228 has its leading end inserted slidably into the center bore 229 of a rod holding portion 198C fitted in the bore of the adjusting member 198. The guide rod 228 has its foremost end formed with an external thread 234 which is screwed in an internally threaded bore 236 formed to project from the rear end of the feeding piston 200.

A U-packing **198*a* and an O-ring 198*b* are fitted in the center bore 229 of the holding portion of the adjusting member 198, and an O-ring 200*a* and a U-packing 200*b* are fitted around the feeding piston 200. An O-ring 208*a* and a U-packing 208*b* are fitted in the inner circumference of the center bore 226 of the head cover 191**.

Next, the construction of the hydraulic circuit will be described in the following.

The intermediate-diameter cylinder bore 194 is formed with a hydraulic port 244 at is deepest portion and with a hydraulic port 246 at its portion closest to the side of the cylinder bore 192. The hydraulic ports 244 and 246 are connected through hydraulic lines 248 and 250, respectively, to an electromagnetic four-way valve 252. This electromagnetic four-way valve 252 is a pump closed center type four-port three-position change-over valve having solenoids **252*a* and 252*b* at its two ends and a spring at its center. This four-way valve 252 is connected through a line 254 to a hydraulic pump 256 and through a line 258 to an oil tank 260. The pump 256 is equipped with a drive motor 262 and connected through a line 264 to an oil tank 266. The line 254 is connected through a relief valve 268 to an oil tank 270**.

The operations of the casting apparatus thus constructed will be described in the following.

Incidentally, the molten metal is introduced into the cavity 26 at first at the casting step, but these procedures will not be described because they are shared with the apparatus of FIGS. 11 to 14.

After the cavity 26 has been charged up with the molten metal, the feeding operation is accomplished in the following manner to proceed the casting step by the actions of the cylinder mechanism 190 and the hydraulic circuit 202.

Figure 17:
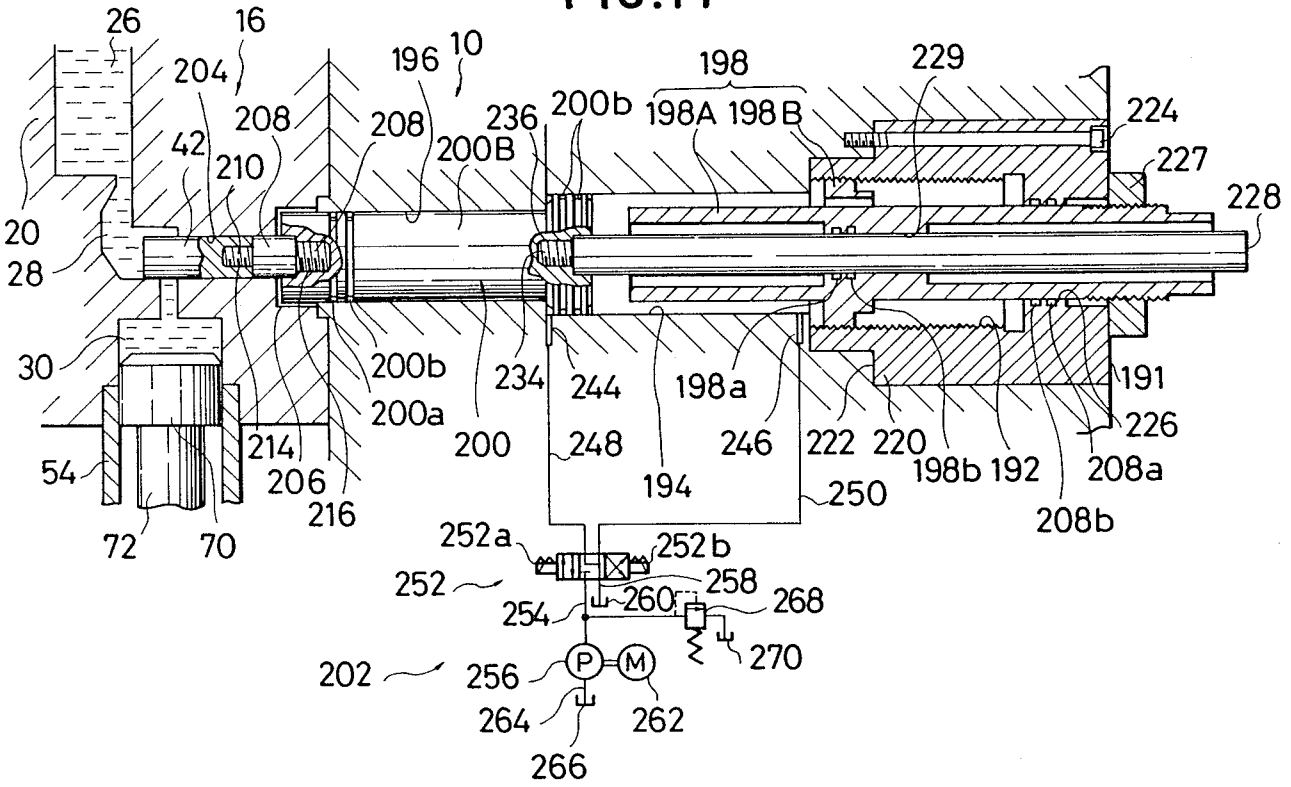
FIGS. 17, 18, 19 and 20 are views for explaining the operations.

If, in the state shown in FIG. 16, the solenoid **252*b* of the electromagnetic four-way valve 252 is energized, communication is established between the hydraulic lines 254 and 250, as shown in FIG. 17 to introduce the oil pressure from the hydraulic pump 256 through the hydraulic port 246 into the cylinder bore 194 thereby to push and move forward the feeding piston 200. As a result, the feeding rod 42 is protruded into the runner 28**.

Figure 18:
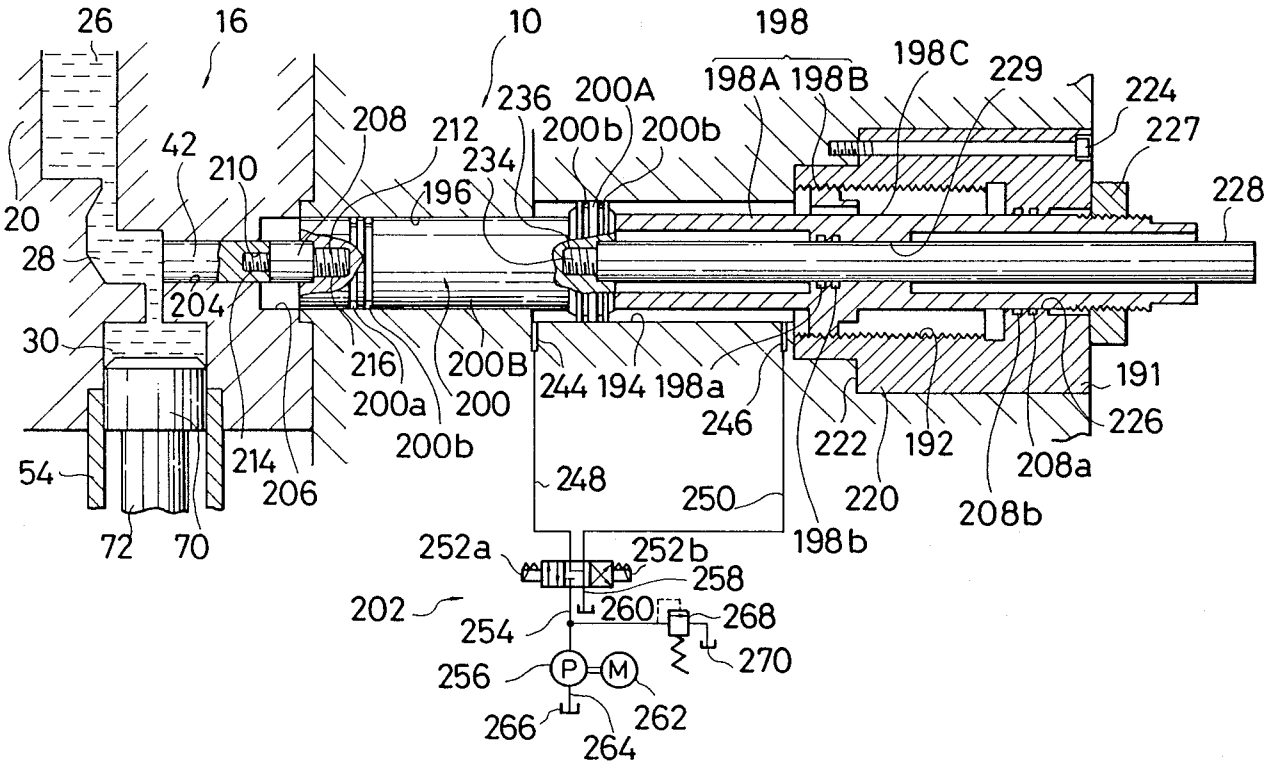

Next, in order to retract the feeding rod 42 from the feeding state into the stationary mold 16, the solenoid **252*a* of the electromagnetic four-way valve 252 is energized, as shown in FIG. 18. As a result, the communication between the hydraulic lines 248 and 254 is established to introduce the oil pressure of the hydraulic pump 256 from the hydraulic port 244 into the cylinder bore 194. This oil pressure pushes the piston portion 200A of the feeding piston 200 righwardly of the drawing to move the feeding piston 200 rightwardly of the drawing until the feeding piston 200 comes into abutment against the adjusting member 190, so that the feeding rod 42 is retracted into the bore 204 of the stationary mold 16. At this time, the oil pressure in the righthand chamber of the piston portion 200A is released through the port 246 and the lines 250 and 258 into the oil tank 260**.

Figure 19:
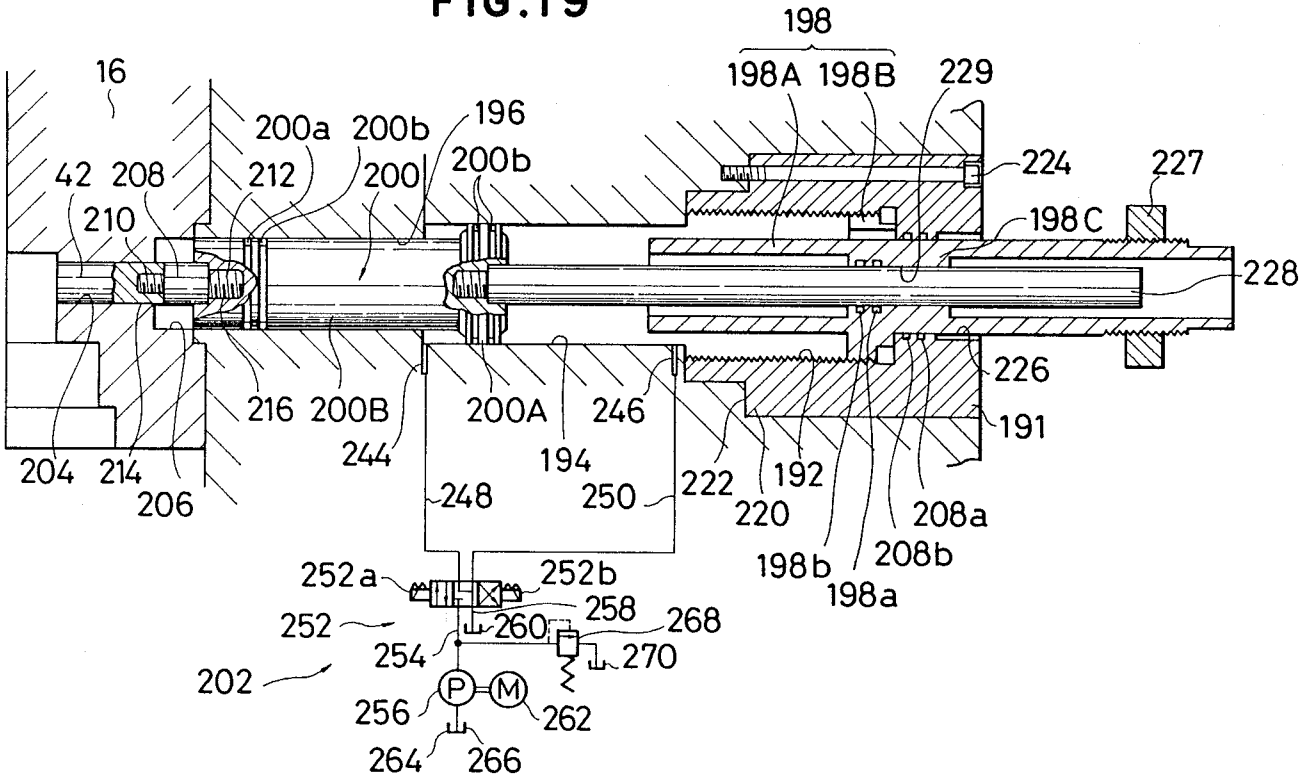
Figure 20:
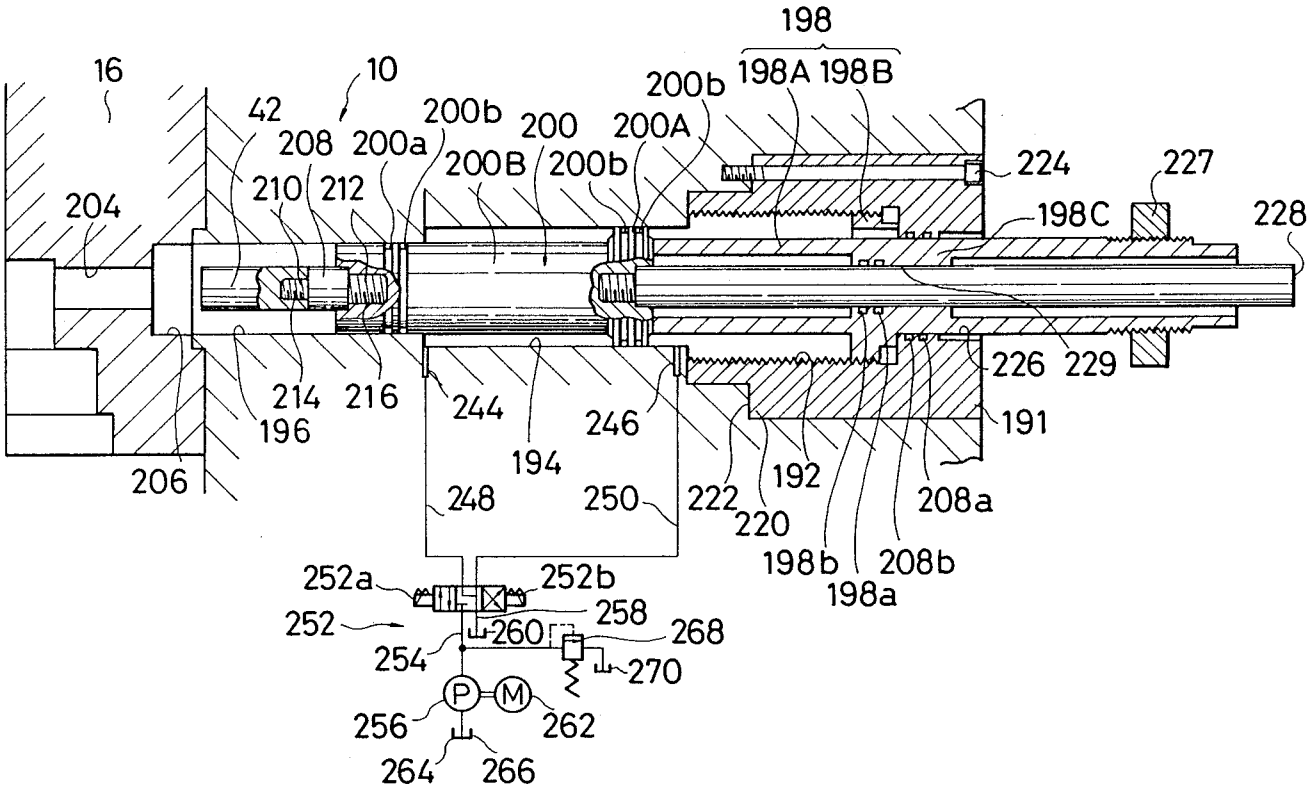

In case the stationary mold 16 is to be removed from the stationary board 14, the feeding rod 42 is retracted into the stationary board 14. In order to effect this retraction, the adjusting member 198 is turned forward on its axis. Then, the adjusting member 198 is moved righwardly of the drawing, as shown in FIG. 19, because the aforementioned nut portion 198B is screwed in the internal thread of the inner circumference of the cylinder bore 192. (Incidentally, the internal threads of the lock nut 227 and the cylinder bore 192 are reversed.) As shown in FIG. 20, therefore, the solenoid **252*a* of the electromagnetic four-way valve 252 is energized to introduce the oil pressure into the rod end of the feeding piston 200 thereby to move the same piston 200 rightwardly of the drawing. As a result, the feeding rod 42 is further moved rightwardly from the state of FIG. 18 until it is retracted into the stationary board 10 (i.e., the cylinder bore 196), as shown in FIG. 20. As a result, the feeding rod 42 is not protruded in the least from the stationary board 14 so that the stationary mold 16** can be mounted and demounted remarkably easily and promptly.

In the embodiments of FIGS. 11 to 20, the mold disclosed is of the transverse clamping type, and the pouring unit disclosed is of the vertical casting type. Despite of this fact, however, the present invention can apparently be applied to an injection molding machine having various molds and pouring units.

What is claimed is:

1. A casting apparatus comprising:

a mold including a cavity for solidifying molten metal therein, and a runner and a biscuit portion for introducing the molten metal into said cavity;

means removably mounted in said biscuit portion for feeding the molten metal through said biscuit portion and runner into said cavity;

a feeding rod disposed in said mold for freely protruding into said runner, and means for reciprocating said feeding rod; and means for selecting communication and non-communication between said biscuit portion and said runner to allow the molten metal to flow from said biscuit portion to said runner, said communication and non-communication means being actuated to close the runner from the biscuit portion after the molten metal is fed into the cavity so that when the feeding rod is actuated, the molten metal in the cavity is compressed.

2. A casting apparatus according to claim 1, wherein said communication and non-communication selecting means includes: a blocking rod capable of being freely protruded into and retrated from said runner; and means for reciprocating said blocking rod to block communication between said runner and said biscuit portion when said blocking rod is protruded and to establish communication between said runner and said biscuit portion when the same is retracted.

3. A casting apparatus according to claim 1, wherein said means for reciprocating said feeding rod is a hydraulic cylinder.

4. A casting apparatus according to claim 2, wherein said means for reciprocating said blocking rod is a hydraulic cylinder.

5. A casting apparatus according to claim 1, wherein said mold includes: a stationary mold and a movable mold adapted to be coupled to said stationary mold, wherein said stationary mold and said movable mold define said cavity, said runner and said biscuit portion inbetween when they are coupled to each other.

6. A casting apparatus according to claim 1, wherein said molten metal feeding means includes: a plunger tip adapted to be reciprocated by an injection cylinder; and a sleeve fitting said plunger tip slidably therein, wherein the molten metal is injected into said mold by forward movement of said plunger tip.

7. A casting apparatus according to claim 5, wherein said feeding rod is disposed in said stationary mold.

8. A casting apparatus comprising:

a mold including a cavity for solidifying molten metal therein, and a runner and a biscuit portion for introducing the molten metal into said cavity, said runner having a communication port;

means removably mounted in said biscuit portion for feeding the molten metal through said biscuit portion and runner into said cavity; and a feeding rod disposed in said mold for freely protruding into said runner, and means for reciprocating said feeding rod, said feeding rod, after the molten metal is fed into the cavity, being disposed to cover the communication port of said runner with said cavity to leave a gap of 0.5 and 5 mm between said communication port and said feeding rod.

9. A casting apparatus according to claim 8, wherein said means for reciprocating said feeding rod is a hydraulic cylinder mechanism.

10. A casting apparatus according to claim 8, wherein said mold includes: a stationary mold and a movable mold adapted to be coupled to said stationary mold, wherein said stationary mold and said movable mold define said cavity, said runner and said biscuit portion in-between when they are coupled to each other.

11. A casting apparatus according to claim 8, wherein said molten metal feeding means includes: a plunger tip adapted to be reciprocated by an injection cylinder; and a sleeve fitting said plunger tip slidably therein, wherein the molten metal is injected into said mold by forward movement of said plunger tip.

12. A casting apparatus according to claim 10, wherein said feeding rod is disposed in said stationary mold.

13. A casting apparatus comprising:

a mold including a cavity for solidifying molten metal therein, and a runner and a biscuit portion for introducing the molten metal into said cavity;

means removably mounted in said biscuit portion for feeding the molten metal through said biscuit portion and runner into said cavity; and a feeding rod disposed in said mold for freely protruding into said runner and having a slope with a receiving face oriented toward the cavity side, and means for reciprocating said feeding rod, said feeding rod, after the molten metal is fed into the cavity, being protruded into said runner to block communication of the runner with the biscuit portion and to push the molten metal in the cavity.

14. A casting apparatus according to claim 13, wherein said means for reciprocating said feeding rod is a hydraulic cylinder mechanism.

15. A casting apparatus according to claim 13, wherein said mold includes: a stationary mold and a movable mold adapted to be coupled to said stationary mold, wherein said stationary mold and said movable mold define said cavity, said runner and said biscuit portion in-between when they are coupled to each other.

16. A casting apparatus according to claim 13, wherein said molten metal feeding means includes: a plunger tip adapted to be reciprocated by an injection cylinder; and a sleeve fitting said plunger tip slidably therein, wherein the molten metal is injected into said mold by forward movement of said plunger tip.

17. A casting apparatus according to claim 15, wherein said feeding rod is disposed in said stationary mold.

18. A casting apparatus comprising:

a stationary mold and a movable mold capable of being coupled to said stationary mold for forming a space for molten metal inbetween when said molds are coupled to each other;

a stationary board attached to said stationary mold;

a movable board carrying said movable mold;

moving means for moving said movable board to couple and uncouple said movable mold relative to said stationary mold;

means for injecting the molten metal into the space formed by the stationary mold and the movable mold;

a feeding rod fixed to said stationary board and capable of extending through said stationary mold and protruding into said space for the molten metal; and means attached to said stationary board for moving said feeding rod back and forth and operating to move the feeding rod to take one of a first position where the feeding rod is protruded into the space, a second position where the feeding rod is retracted into the stationary mold, and a third position where the feeding rod is retracted into the stationary board, so that said stationary mold can be freely mounted and demounted in case the feeding rod takes the third position.

19. A casting apparatus according to claim 18, wherein said means for moving said feeding rod back and forth includes: a cylinder bore formed in said stationary board; and a piston fitted in said cylinder bore.

20. A casting apparatus according to claim 18, wherein said means for moving said feeding rod back and forth is a multiple cylinder mechanism.

21. A casting apparatus according to claim 18, wherein said feeding rod is protruded into a runner in said space for the molten metal.

22. A casting apparatus according to claim 18, wherein said molten metal feeding means includes: a plunger tip adapted to be reciprocated by an injection cylinder; and a sleeve fitting said plunger tip slidably therein, wherein the molten metal is injected into said mold by forward movement of said plunger tip.

23. A casting apparatus according to claim 18, wherein said means for moving said feeding rod back and forth includes:

a cylinder bore formed in said stationary board;

a piston fitted in said cylinder bore and connected to said feeding rod; and means for adjusting the retraction limit of said piston.

24. A casting apparatus according to claim 23, wherein said means for adjusting the retraction limit includes:

a head cover disposed in said stationary board and having an internally threaded bore extending from said cylinder bore; and a retraction limit adjusting member formed on its outer circumference with an external thread meshing with the internal thread of said head cover and having its leading end inserted into said cylinder bore and its trailing end protruded through said head cover to outside, said member being moved forward, when its protruded portion is turned, by engagement between said external thread and said internal thread to change the position thereof in the axial direction of said cylinder bore so that the retraction limit of said piston by the abutment of said piston against the leading end of said member is adjusted.

* * * * *